US011359264B2

(12) United States Patent
Yoshida et al.

(10) Patent No.: US 11,359,264 B2
(45) Date of Patent: Jun. 14, 2022

(54) ALUMINUM ALLOY AND DIE CASTING METHOD

(71) Applicant: Aisin Keikinzoku Co., Ltd., Toyama (JP)

(72) Inventors: Tomoo Yoshida, Toyama (JP); Shinichi Asai, Imizu (JP)

(73) Assignee: AISIN KEIKINZOKU CO., LTD.

( * ) Notice: Subject to any disclaimer, the term of this patent is extended or adjusted under 35 U.S.C. 154(b) by 130 days.

(21) Appl. No.: 16/841,794

(22) Filed: Apr. 7, 2020

(65) Prior Publication Data

US 2020/0232069 A1 Jul. 23, 2020

Related U.S. Application Data

(60) Division of application No. 15/222,176, filed on Jul. 28, 2016, now abandoned, which is a continuation of (Continued)

(30) Foreign Application Priority Data

Mar. 31, 2014 (JP) ..... 2014-071281

(51) Int. Cl.
*C22C 21/02* (2006.01)
*B22D 17/20* (2006.01)

(Continued)

(52) U.S. Cl.
CPC ..... *C22C 21/02* (2013.01); *B22D 17/00* (2013.01); *B22D 17/02* (2013.01); *B22D 17/08* (2013.01);

(Continued)

(58) Field of Classification Search
CPC ..... C22C 21/02
See application file for complete search history.

(56) References Cited

U.S. PATENT DOCUMENTS 5,837,070 A 11/1998 Sainfort et al.
6,824,737 B2 11/2004 Koch
2003/0037900 A1* 2/2003 Winterbottom ..... B22D 17/007 164/113

FOREIGN PATENT DOCUMENTS

JP 59-189055 A 10/1984
JP 09-501988 A 2/1997

(Continued)

OTHER PUBLICATIONS

English machine translation of JP 2000-054047 A of Katto (Year: 2000).*

(Continued)

*Primary Examiner* — Jophy S. Koshy
(74) *Attorney, Agent, or Firm* — Harness, Dickey & Pierce, P.L.C.

(57) ABSTRACT

A method for casting an aluminum alloy includes: pouring molten metal of an aluminum alloy comprising 6.0 to 9.0 mass % of Si, 0.4 to 0.8 mass % of Mg, 0.25 to 1.0 mass % of Cu, 0.08 to 0.25 mass % of Fe, 0.6 mass % or less of Mn, 0.2 mass % or less of Ti, and 0.01 mass % or less of Sr, with the balance being Al and unavoidable impurities into a shot sleeve of a die casting machine; filling a mold cavity of a center-gate die with the molten metal at a gate speed of 1 msec or less so as to produce a laminar flow, and subjecting T5 heat treatment so as to obtain the aluminum alloy having a tensile strength of 240 MPa or more.

3 Claims, 5 Drawing Sheets

Related U.S. Application Data application No. PCT/JP2014/084505, filed on Dec. 26, 2014.

(51) Int. Cl.

| | |
|---|---|
| ***B22D 17/22*** | (2006.01) |
| ***B22D 17/00*** | (2006.01) |
| ***B22D 17/02*** | (2006.01) |
| ***B22D 17/08*** | (2006.01) |
| ***B22D 21/00*** | (2006.01) |
| *C22F 1/043* | (2006.01) |

(52) U.S. Cl.

CPC ..... *B22D 17/20* (2013.01); *B22D 17/2007* (2013.01); *B22D 17/2023* (2013.01); *B22D 17/22* (2013.01); *B22D 21/007* (2013.01); *C22F 1/043* (2013.01)

(56) References Cited

FOREIGN PATENT DOCUMENTS

| | | | |
|---|---|---|---|
| JP | 09-125181 | A | 5/1997 |
| JP | 10-036933 | A | 2/1998 |
| JP | 10-036934 | A | 2/1998 |
| JP | 11-293429 | A | 10/1999 |
| JP | 2000-054047 | A | 2/2000 |
| JP | 4970709 | B2 | 7/2012 |
| WO | 95-034691 | A1 | 12/1995 |

OTHER PUBLICATIONS

"Technology Manual: Development, processes and material information for cast components made of aluminum and magnesium", KSM Castings Group GmbH, Hildesheim, Germany, 2013 (56 pages).

* cited by examiner

FIG. 1A

| | CHEMICAL COMPONENT (MASS%) | | | | | | | | | | | | TEMPER |
|---|---|---|---|---|---|---|---|---|---|---|---|---|---|
| | Cu | Si | Fe | Zn | Mg | Mn | Ni | Sn | Ti | Cr | Sr | Al | |
| EXAMPLE 1 | 0.79 | 7.4 | 0.08 | 0.00 | 0.49 | 0.41 | 0.00 | 0.00 | 0.12 | 0.00 | 0.006 | BALANCE | T5 |
| EXAMPLE 2 | 0.29 | 8.0 | 0.17 | 0.00 | 0.71 | 0.22 | 0.01 | 0.00 | 0.11 | 0.00 | 0.010 | BALANCE | T5 |
| EXAMPLE 3 | 0.80 | 8.0 | 0.17 | 0.00 | 0.69 | 0.22 | 0.01 | 0.00 | 0.11 | 0.00 | 0.008 | BALANCE | T5 |
| EXAMPLE 4 | 0.50 | 7.9 | 0.11 | 0.00 | 0.51 | 0.00 | 0.01 | 0.00 | 0.12 | 0.00 | 0.007 | BALANCE | T5 |
| EXAMPLE 5 | 0.51 | 8.0 | 0.23 | 0.00 | 0.51 | 0.00 | 0.01 | 0.00 | 0.11 | 0.00 | 0.006 | BALANCE | T5 |
| EXAMPLE 6 | 0.51 | 8.0 | 0.11 | 0.00 | 0.53 | 0.56 | 0.01 | 0.00 | 0.11 | 0.00 | 0.008 | BALANCE | T5 |
| EXAMPLE 7 | 0.52 | 8.0 | 0.23 | 0.00 | 0.53 | 0.55 | 0.01 | 0.00 | 0.11 | 0.00 | 0.007 | BALANCE | T5 |
| EXAMPLE 8 | 0.61 | 8.0 | 0.17 | 0.00 | 0.58 | 0.22 | 0.01 | 0.00 | 0.11 | 0.00 | 0.008 | BALANCE | T5 |
| EXAMPLE 9 | 0.52 | 8.8 | 0.18 | 0.00 | 0.50 | 0.20 | 0.01 | 0.00 | 0.10 | 0.00 | 0.006 | BALANCE | T5 |
| EXAMPLE 10 | 0.52 | 7.3 | 0.18 | 0.00 | 0.45 | 0.21 | 0.01 | 0.00 | 0.10 | 0.00 | 0.007 | BALANCE | T5 |
| EXAMPLE 11 | 0.83 | 8.7 | 0.18 | 0.00 | 0.74 | 0.19 | 0.01 | 0.00 | 0.10 | 0.00 | 0.008 | BALANCE | T5 |
| EXAMPLE 12 | 0.51 | 8.6 | 0.22 | 0.00 | 0.53 | 0.49 | 0.01 | 0.00 | 0.10 | 0.00 | 0.006 | BALANCE | T5 |
| COMPARATIVE EXAMPLE 1 | 2.52 | 11.3 | 0.65 | 0.01 | 0.29 | 0.00 | 0.00 | 0.00 | 0.09 | 0.00 | 0.000 | BALANCE | F |
| COMPARATIVE EXAMPLE 2 | 2.52 | 11.3 | 0.65 | 0.01 | 0.29 | 0.00 | 0.00 | 0.00 | 0.09 | 0.00 | 0.000 | BALANCE | T6 |
| COMPARATIVE EXAMPLE 3 | 2.52 | 11.3 | 0.65 | 0.01 | 0.29 | 0.00 | 0.00 | 0.00 | 0.09 | 0.00 | 0.005 | BALANCE | T5 |
| COMPARATIVE EXAMPLE 4 | 0.00 | 6.7 | 0.09 | 0.01 | 0.41 | 0.01 | 0.00 | 0.00 | 0.11 | 0.00 | 0.005 | BALANCE | T6 |
| COMPARATIVE EXAMPLE 5 | 0.00 | 6.7 | 0.09 | 0.01 | 0.41 | 0.01 | 0.00 | 0.00 | 0.11 | 0.00 | 0.000 | BALANCE | T5 |
| COMPARATIVE EXAMPLE 6 | 3.20 | 9.5 | 0.12 | 0.01 | 0.31 | 1.05 | 0.00 | 0.00 | 0.02 | 0.00 | 0.000 | BALANCE | T6 |
| COMPARATIVE EXAMPLE 7 | 3.20 | 9.5 | 0.12 | 0.01 | 0.31 | 1.05 | 0.00 | 0.00 | 0.02 | 0.00 | 0.000 | BALANCE | T5 |
| COMPARATIVE EXAMPLE 8 | 2.60 | 7.9 | 0.12 | 0.01 | 0.29 | 1.20 | 0.00 | 0.00 | 0.03 | 0.00 | 0.005 | BALANCE | T6 |
| COMPARATIVE EXAMPLE 9 | 0.06 | 6.1 | 0.48 | 0.01 | 0.44 | 0.58 | 0.00 | 0.00 | 0.00 | 0.00 | 0.000 | BALANCE | T5 |
| COMPARATIVE EXAMPLE 10 | 0.79 | 7.4 | 0.08 | 0.01 | 0.49 | 0.41 | 0.00 | 0.00 | 0.12 | 0.00 | 0.006 | BALANCE | T6 |
| COMPARATIVE EXAMPLE 11 | 0.50 | 7.7 | 0.11 | 0.01 | 0.31 | 0.00 | 0.00 | 0.00 | 0.11 | 0.00 | 0.006 | BALANCE | T5 |
| COMPARATIVE EXAMPLE 12 | 0.50 | 7.7 | 0.11 | 0.01 | 0.31 | 0.00 | 0.00 | 0.00 | 0.11 | 0.00 | 0.003 | BALANCE | T6 |

FIG. 1B

| | MECHANICAL PROPERTIES | | | | | | CORROSION RESISTANCE | OVERALL EVALUATION |
|---|---|---|---|---|---|---|---|---|
| | TENSILE STRENGTH (Mpa) | | YIELD STRENGTH (Mpa) | | ELON-GATION (%) | | | |
| | 240 OR MORE | | 150 OR MORE | | 4 OR MORE | | | |
| EXAMPLE 1 | 349 | ○ | 270 | ○ | 4 | ○ | ○ | ○ |
| EXAMPLE 2 | 269 | ○ | 205 | ○ | 7 | ○ | ○ | ○ |
| EXAMPLE 3 | 289 | ○ | 214 | ○ | 6 | ○ | ○ | ○ |
| EXAMPLE 4 | 289 | ○ | 211 | ○ | 11 | ○ | ○ | ○ |
| EXAMPLE 5 | 268 | ○ | 204 | ○ | 6 | ○ | ○ | ○ |
| EXAMPLE 6 | 289 | ○ | 218 | ○ | 6 | ○ | ○ | ○ |
| EXAMPLE 7 | 283 | ○ | 214 | ○ | 6 | ○ | ○ | ○ |
| EXAMPLE 8 | 288 | ○ | 204 | ○ | 9 | ○ | ○ | ○ |
| EXAMPLE 9 | 257 | ○ | 200 | ○ | 6 | ○ | ○ | ○ |
| EXAMPLE 10 | 290 | ○ | 210 | ○ | 8 | ○ | ○ | ○ |
| EXAMPLE 11 | 265 | ○ | 217 | ○ | 6 | ○ | ○ | ○ |
| EXAMPLE 12 | 256 | ○ | 211 | ○ | 5 | ○ | ○ | ○ |
| COMPARATIVE EXAMPLE 1 | 295 | ○ | 185 | ○ | 2 | × | ○ | × |
| COMPARATIVE EXAMPLE 2 | 353 | ○ | 297 | ○ | 2 | × | ○ | × |
| COMPARATIVE EXAMPLE 3 | 269 | ○ | 220 | ○ | 2 | × | ○ | × |
| COMPARATIVE EXAMPLE 4 | 320 | ○ | 280 | ○ | 11 | ○ | ○ | × |
| COMPARATIVE EXAMPLE 5 | 235 | × | 147 | × | 15 | ○ | ○ | × |
| COMPARATIVE EXAMPLE 6 | 349 | ○ | 296 | ○ | 2 | × | ○ | × |
| COMPARATIVE EXAMPLE 7 | 283 | ○ | 198 | ○ | 2 | × | ○ | × |
| COMPARATIVE EXAMPLE 8 | 366 | ○ | 322 | ○ | 3 | × | ○ | × |
| COMPARATIVE EXAMPLE 9 | 242 | ○ | 185 | ○ | 7 | ○ | × | × |
| COMPARATIVE EXAMPLE 10 | 357 | ○ | 255 | ○ | 7 | ○ | ○ | × |
| COMPARATIVE EXAMPLE 11 | 238 | × | 167 | ○ | 10 | ○ | ○ | × |
| COMPARATIVE EXAMPLE 12 | 341 | ○ | 239 | ○ | 12 | ○ | ○ | × |

<EXAMPLE 1>

COMPARATIVE EXAMPLE 1

COMPARATIVE EXAMPLE 6

COMPARATIVE EXAMPLE 10

ALUMINUM ALLOY AND DIE CASTING METHOD

CROSS REFERENCE TO RELATED APPLICATION

This application is a divisional of U.S. patent application Ser. No. 15/222,176, filed Jul. 28, 2016, which is a continuation of International Patent Application No. PCT/JP2014/084505, having an international filing date of Dec. 26, 2014, which designated the United States, the entirety of which is incorporated herein by reference. Japanese Patent Application No. 2014-071281 filed on Mar. 31, 2014 is also incorporated herein by reference in its entirety.

TECHNICAL FIELD

The present invention relates to an aluminum alloy that is used for a die casting process (aluminum die casting process), and a casting method.

BACKGROUND ART

A die casting process has high productivity, and is used in a wide variety of fields in which aluminum parts (e.g., automotive parts and mechanical parts) are used.

An aluminum alloy that is equivalent to a Japanese Industrial Standards (JIS) ADC12 alloy is generally used as an aluminum alloy used for the die casting process.

The JIS ADC12 alloy exhibits excellent castability. However, since a product obtained by subjecting the JIS ADC12 alloy to the die casting process has a coarse needle-like metal microstructure, fracture easily occurs from the precipitates, and it is difficult to obtain sufficient strength.

Therefore, it is necessary to increase the thickness of the product from the viewpoint of safety.

When a T6 treatment is employed to improve strength, an increase in cost occurs. Moreover, when producing a product that partially has a large thickness, deformation may occur due to thermal strain.

Japanese Patent No. 4970709 discloses an aluminum alloy that is used for a die casting process and exhibits high elongation in an as-cast state. In Japanese Patent No. 4970709, it is indispensable to add molybdenum to the aluminum alloy.

SUMMARY OF THE INVENTION

Technical Problem

An object of the invention is to provide an aluminum alloy that is used for a die casting process, and exhibits excellent internal quality, high elongation, and high strength, and a method for casting the same.

Solution to Problems

An aluminum alloy according to one aspect of the invention includes 6.0 to 9.0 mass % of Si, 0.4 to 0.8 mass % of Mg, 0.25 to 1.0 mass % of Cu, 0.08 to 0.25 mass % of Fe, 0.6 mass % or less of Mn, 0.2 mass % or less of Ti, and 0.01 mass % or less of one element selected from the group consisting of Sr, Sb, Ca, and Na with the balance being Al and unavoidable impurities.

A casting method according to another aspect of the invention includes pouring molten metal of an Al—Si—Cu—Mg-based aluminum alloy into a shot sleeve of a die casting machine, and filling a mold cavity of a center-gate die with the molten metal at a gate speed of 1 msec or less so as to produce a laminar flow.

A release agent is normally applied to the inside of the mold cavity or the like when implementing a die casting process. A solution-type release agent (e.g., oily release agent or water-soluble release agent) may be used when implementing the casting method.

In the invention, it is preferable to apply a powdery release agent to the inside of the mold cavity.

A powdery release agent suppresses a decrease in die temperature.

The above alloy composition is selected for the reasons described below.

Si

The Si content must be 6 mass % or more in order to obtain fluidity during casting. In the invention, the Si content is set to achieve a hypo-eutectic region.

When the Si content is set to achieve a hypo-eutectic region, the precipitation of coarse Si primary crystals and fracture therefrom rarely occur. Therefore, it is possible to obtain an elongation that is required to provide the aluminum alloy with good mechanical properties.

Therefore, the Si content is preferably set to 6.0 to 9.0 mass %.

Mg and Cu

Mg and Cu are required to provide the aluminum alloy with high strength. The Mg content is preferably set to 0.4 to 0.8 mass %, and the Cu content is preferably set to 0.25 to 1.0 mass %.

Fe

Fe improves toughness when the Fe content is low. If the Fe content exceeds 0.25 mass %, a decrease in ductility may occur.

Fe is easily mixed as impurities. It is necessary to increase the purity of the master alloy (i.e., an increase in cost occurs) in order to reduce the Fe content.

Therefore, the Fe content is preferably set to 0.08 to 0.25 mass %.

Mn

The addition of a small amount of Mn is effective for preventing the alloy from burning and sticking together with the mold during the die casting process.

When Mn is added to the aluminum alloy, the Mn content is preferably set to 0.6 mass % or less.

Sr, Sb, Ca, and Na

The addition of a small amount of Sr, Sb, Ca, or Na (modifier) is effective for achieving the refinement of eutectic silicon.

It is preferable to add one element among Sr, Sb, Ca, and Na in ratio of 0.01 mass % or less.

Ti

Ti is effective for achieving the refinement of crystal grains during casting. Ti may be added in a ratio of 0.2 mass % or less.

A small amount of B is included in the aluminum alloy when Ti is added to the master alloy.

When the aluminum alloy having the above structure is used, an F material obtained by air-cooling the product obtained by the die casting process, or a T5 material obtained by tempering the F material exhibits improved strength, and it is unnecessary to use a T6 treatment that increases cost.

It is also effective to reduce internal defects of the cast product in order to reduce the thickness of the cast product.

Therefore, it is preferable to pour molten metal of an Al—Si—Cu—Mg-based aluminum alloy into a shot sleeve of a die casting machine, and fill the mold cavity of a center-gate die with the molten metal at a gate speed of 1 msec or less so as to produce a laminar flow.

The type of the die casting machine is not particularly limited as long as the center gate can be provided to the die.

It is preferable to maintain the die temperature when casting a product having a small thickness. Therefore, it is preferable to use a powdery release agent that exhibits thermal insulation properties rather than a water-soluble release agent.

In the invention, Zn, Ni, Sn, Cr, and the like are considered to be unavoidable impurities. These elements may be included in the aluminum alloy each in a ratio of 0.03 mass % or less.

Advantageous Effects of Invention

The aluminum alloy having the chemical composition according to the invention exhibits fluidity due to Si, exhibits improved strength due to Mg and Cu, has a lower Fe content as compared with a known aluminum alloy, and exhibits improved elongation through modification with Sr and the like. Therefore, the aluminum alloy exhibits high strength without the need for a T6 treatment.

Therefore, it is possible to reduce or suppress an increase in cost that may occur when a T6 treatment is used, and eliminate the occurrence of thermal strain due to quenching, so that the dimensional accuracy of a product having a small thickness can be improved.

It is possible to improve internal quality by employing the laminar flow die casting process. It is possible to further improve internal quality by employing the center-gate die design.

Note that it is preferable to provide an intermediate die between a movable die and a stationary die when casting an undercut product.

BRIEF DESCRIPTION OF DRAWINGS

FIGS. 1A and 1B illustrate the chemical components of aluminum alloys subjected to evaluation, and the evaluation results.

DESCRIPTION OF EMBODIMENTS

The aluminum alloy and the casting method according to the invention are further described below.

Molten metal of each aluminum alloy including the chemical components listed in FIG. 1A (having the composition listed in FIG. 1A) was prepared, and subjected to a die casting process to produce a product. It may be possible to add one element among Sb, Ca, and Na in ratio of 0.01 mass % or less instead of Sr in FIG. 1A, since Sb, Ca, or Na has the same effect as Sr.

A JIS No. 14 proportional test piece was cut from the product, and the mechanical properties were evaluated using the test piece.

The die casting process was performed at a gate speed as low as 1 msec or less so as to produce a laminar flow.

A heat treatment (T5) was then performed at 180° C. for 180 minutes.

Figure 6:
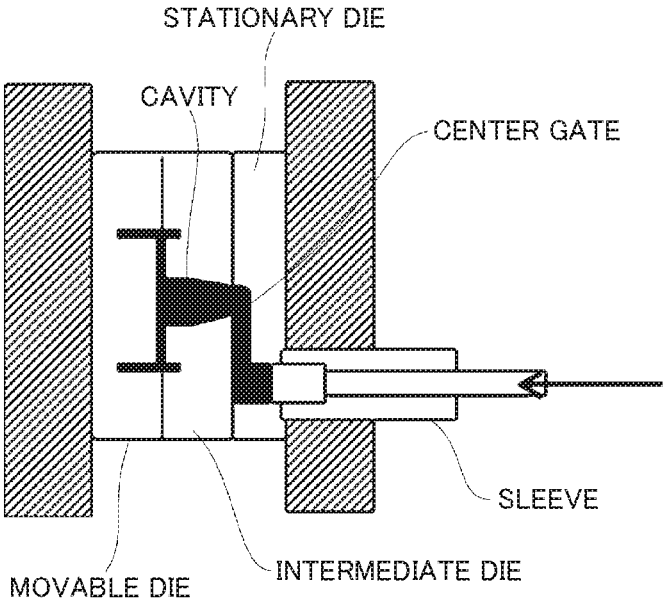
FIG. 6 illustrates an example of a die structure in which an intermediate die is provided between a stationary die and a movable die.

FIG. 6 illustrates an example of the die structure.

The evaluation results are listed in FIG. 1B (table).

In FIG. 1B, the target values are specified for the mechanical properties (tensile strength, yield strength (0.2%), and elongation).

In Examples 1 to 12, the content of each chemical component was set to be within the specific target range, and good mechanical properties were obtained.

Since good mechanical properties were obtained by the T5 heat treatment, it is possible to reduce cost.

In Comparative Examples 1 to 3, the elongation was lower than the target value since a modification was not applied.

In Comparative Example 2, good strength was obtained by a T6 treatment, but the elongation was lower than the target value, and an increase in cost occurs due to the T6 treatment.

In Comparative Example 4, good mechanical properties were obtained. However, since a T6 treatment was applied, an increase in cost occurs.

In Comparative Example 5, good mechanical properties were not obtained by a T5 treatment since the Cu content was low.

In Comparative Example 6, the elongation was lower than the target value since a modification was not applied, and the Cu content and the Si content were outside the specific ranges.

Since the Mn content was high in Comparative Example 6, coarse crystallized products were formed, and the elongation was lower than the target value.

Since a T6 treatment is required in Comparative Example 6, an increase in cost occurs.

In Comparative Example 7, the elongation was lower than the target value since a modification was not applied, and the Cu content and the Si content were outside the specific ranges.

Since the Mn content was high in Comparative Example 7, coarse crystallized products were observed, and the elongation was lower than the target value.

In Comparative Example 8, since the Cu content was outside the specific range, and the Mn content was high, coarse crystallized products were observed, and the elongation was lower than the target value.

In Comparative Example 9, good mechanical properties were not obtained since the Cu content was low.

In Comparative Example 10, a T6 treatment was applied (i.e., an increase in cost occurs).

In Comparative Example 11, good mechanical properties were not obtained since the Mg content was low.

In Comparative Example 12, a T6 treatment was applied (i.e., an increase in cost occurs).

Figure 2A:
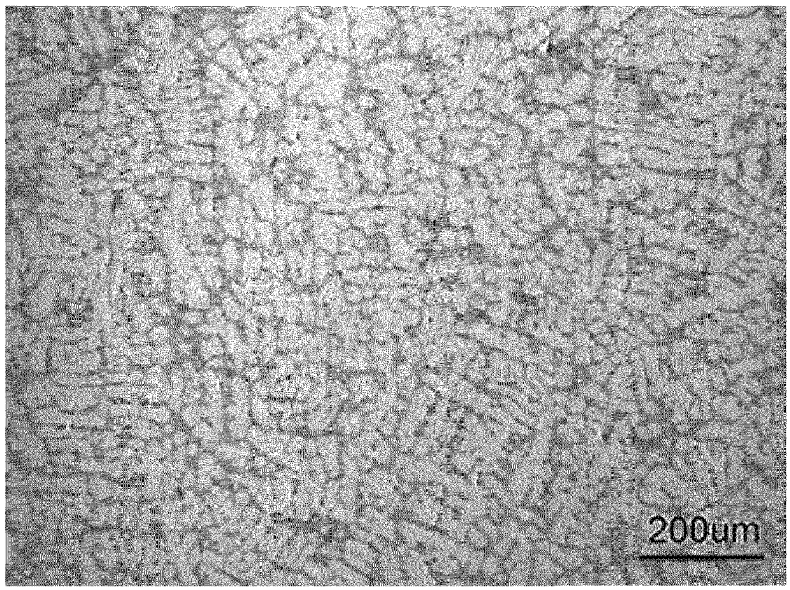
FIGS. 2A and 2B illustrate a photograph of the structure of the aluminum alloy obtained in Example 1.
Figure 2B:
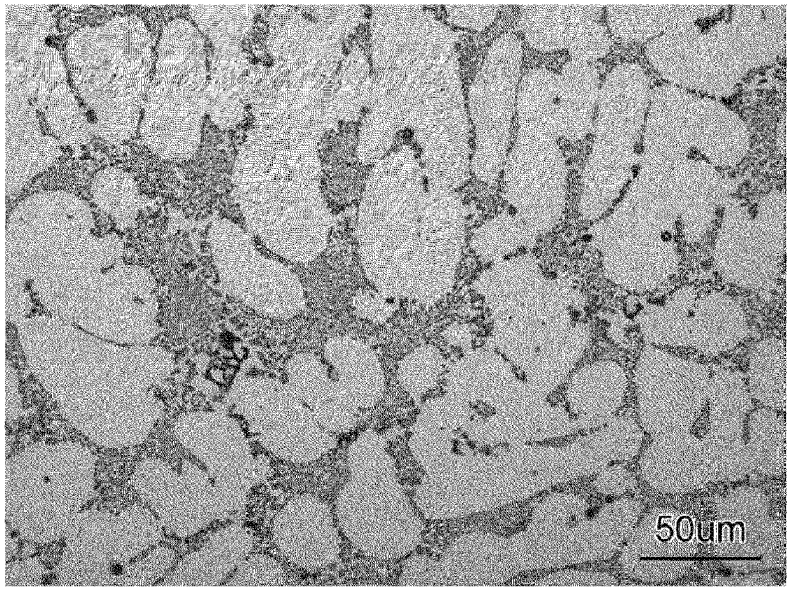
Figure 3A:
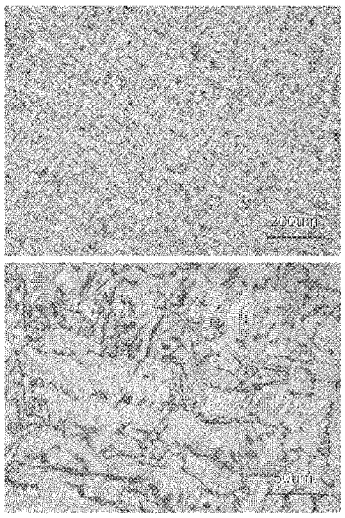
FIG. 3A illustrates a photograph of the structure of the aluminum alloy obtained in Comparative Example 1.
Figure 3B:
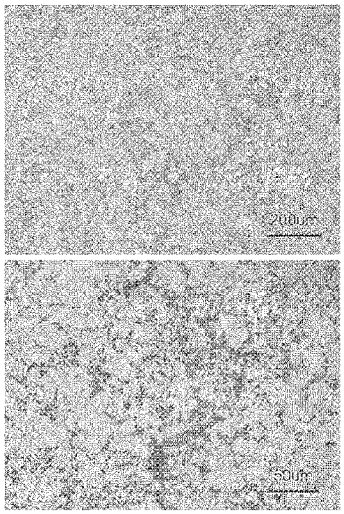
FIG. 3B illustrates a photograph of the structure of the aluminum alloy obtained in Comparative Example 6.
Figure 3C:
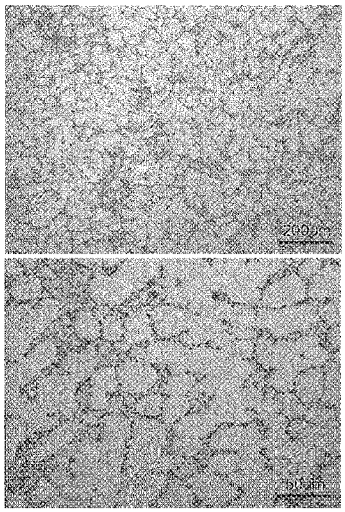
FIG. 3C illustrates a photograph of the structure of the aluminum alloy obtained in Comparative Example 10.
Figure 4A:
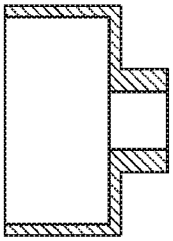
FIGS. 4A to 4D illustrate an example of the shape of a cast product.
Figure 4B:
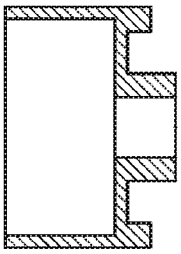
Figure 4C:
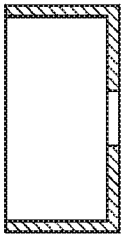
Figure 4D:
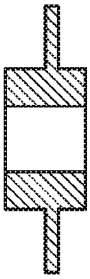

FIGS. 2A and 2B illustrate a photograph of the metal structure obtained in Example 1, FIG. 3A illustrates a photograph of the metal structure obtained in Comparative Example 1, FIG. 3B illustrates a photograph of the metal structure obtained in Comparative Example 6 and FIG. 3C illustrates a photograph of the metal structure obtained in Comparative Example 10.

It was confirmed that eutectic silicon was refined when the aluminum alloy according to the invention was used.

The die structure is described below.

Figure 5:
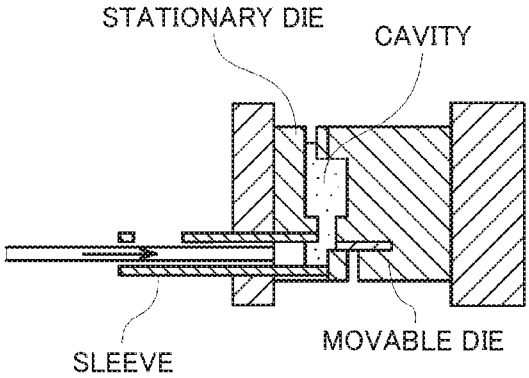
FIG. 5 schematically illustrates the principle of a die casting process.

As illustrated in FIG. 5 (schematic view), a cavity 13 is formed by a stationary die 11 and a movable die 12. When implementing the die casting process, molten metal is poured into a sleeve 14, and injected into the cavity 13.

Die casting machines are classified into a horizontal die casting machine and a vertical die casting machine. A horizontal die casting machine is mainly used at present from the viewpoint of productivity and the like.

Horizontal die casting machines are classified into an under-gate die casting machine (in which the gate is provided on the lower side) (see FIG. 5) and a center-gate die casting machine (in which the gate is provided at the center).

For example, when producing a cylindrical product and the like illustrated in FIGS. 4A to 4D (cross-sectional views), it is possible to suppress the occurrence of segregation and obtain excellent internal quality by injecting the molten metal into the cavity at a position corresponding to the center of the product (see the die structure illustrated in FIG. 6).

Therefore, it is preferable to use a center-gate die, and fill the cavity with the molten metal at a gate speed (i.e., the speed at which the molten metal passes through the runner gate of the die) of 1 msec or less so as to produce a laminar flow.

Note that a center-gate die casting machine in which the gate is provided at the center may also be used (not illustrated in the drawings). When a die structure is formed so that an intermediate die 15 is provided between the stationary die 11 and the movable die 12 (see FIG. 6), it is possible to form a center-gate die having a center gate 11*a* using an under-gate die casting machine (in which the gate is provided on the lower side) by providing a runner between the stationary die 11 and the intermediate die 15.

It is possible to produce products having various shapes (see FIGS. 4A to 4D) by utilizing such a die structure that includes three split dies.

INDUSTRIAL APPLICABILITY

The aluminum alloy according to the invention exhibits high strength without the need for a T6 treatment and can be applied to various automotive parts and various mechanical parts. The aluminum alloy according to the invention exhibits excellent die castability, and achieves high productivity.

What is claimed is:

1. A method for casting an aluminum alloy comprising:

directly pouring molten metal of an aluminum alloy comprising 6.0 to 9.0 mass % of Si, 0.4 to 0.8 mass % of Mg, 0.25 to 1.0 mass % of Cu, 0.08 to 0.25 mass % of Fe, 0.6 mass % or less of Mn, 0.2 mass % or less of Ti, and 0.01 mass % or less of Sr, with the balance being Al and unavoidable impurities into a shot sleeve of a die casting machine;

filling a mold cavity of a center-gate die with the molten metal at a gate speed of 1 m/sec or less so as to produce a laminar flow, and performing T5 heat treatment at 180 degrees C. for 180 minutes so as to obtain the aluminum alloy having a tensile strength of 240 MPa or more.

2. The method as defined in claim 1, wherein a powdery release agent is applied to the inside of the mold cavity.

3. The method as defined in claim 1, wherein the molten metal of aluminum alloy comprising 0.006 to 0.01 mass % of Sr.

* * * * *